United States Patent [19]

Butz

[11] 4,158,576

[45] Jun. 19, 1979

[54] TREATING SURFACES WITH LIQUIDS

[75] Inventor: Erich Butz, Offenbach, Fed. Rep. of Germany

[73] Assignee: Koelsch-Foelger-Werke AK., Siegen, Fed. Rep. of Germany

[21] Appl. No.: 840,737

[22] Filed: Oct. 11, 1977

[30] Foreign Application Priority Data

Oct. 9, 1977 [DE] Fed. Rep. of Germany ..... 2645688

[51] Int. Cl.[2] ..... B08B 7/00; B08B 7/04

[52] U.S. Cl. ..... 134/7; 134/10; 15/302

[58] Field of Search ..... 134/7, 10; 15/302, 320

[56] References Cited

U.S. PATENT DOCUMENTS

| | | | |
|---|---|---|---|
| 1,752,664 | 5/1930 | Forcier | 134/7 |
| 1,934,494 | 11/1933 | Gillespie | 134/7 |
| 2,189,761 | 2/1940 | McKenna | 15/95 |
| 2,536,843 | 1/1951 | Dye | 134/7 |
| 2,802,228 | 8/1957 | Federighi et al. | 15/95 |
| 2,862,222 | 12/1958 | Cockrell | 134/7 |
| 3,116,578 | 1/1964 | Bottler | 51/316 |
| 3,142,590 | 7/1964 | Hengonson | 134/7 |
| 3,205,620 | 9/1965 | Woodworth et al. | 51/8 |
| 3,436,785 | 4/1969 | Kantor | 134/7 |
| 3,461,478 | 8/1969 | Taylor | 134/7 |
| 3,716,066 | 2/1973 | Currier et al. | 134/7 |
| 3,891,456 | 6/1975 | Hohman et al. | 134/3 |
| 4,020,857 | 5/1977 | Rendemonti | 134/7 |

*Primary Examiner*—Joseph Scovronek
*Assistant Examiner*—C. Konkol
*Attorney, Agent, or Firm*—Norman S. Blodgett; Gerry A. Blodgett

[57] ABSTRACT

Process and apparatus for the liquid treatment of a surface by projecting sponge-like elements. The said elements are metered seriation from a hopper in a controlled positive manner by a paddle-wheel means.

6 Claims, 1 Drawing Figure

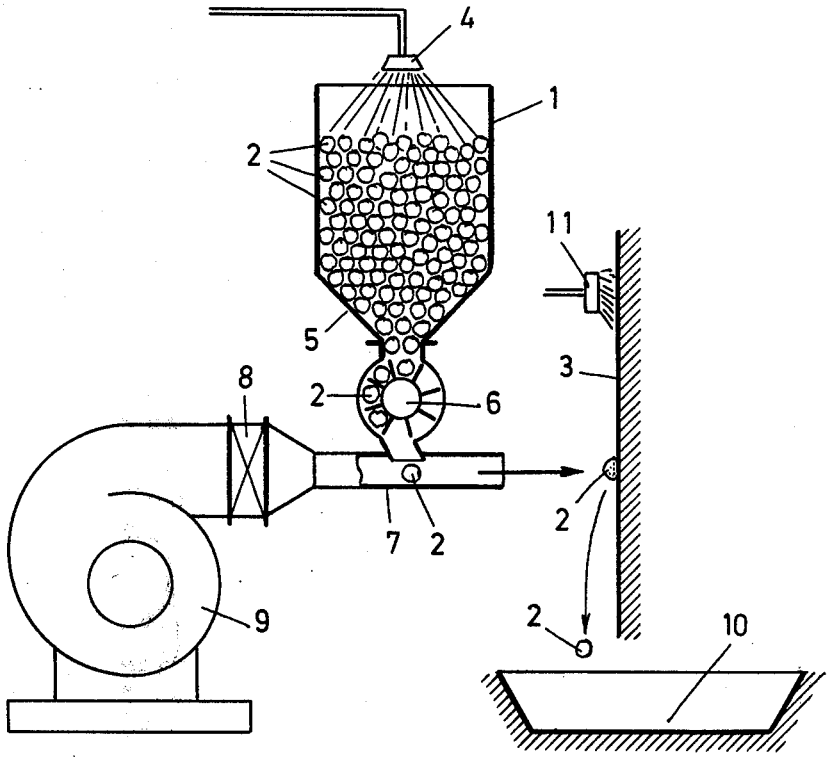
4
1
2
11
5
3
8
2
6
2
7
2
9
2
10

TREATING SURFACES WITH LIQUIDS

BACKGROUND OF THE INVENTION

In the treatment of surfaces with liquids, it is well-known that the treating liquid can be applied by the spraying or squirting that are used in dishwashers or paint spray devices. At the same time, it is considered the state of the art to support the action of spraying or squirting of liquids by means of mechanical auxilliary devices, such as brushes in car-washing machinery.

The process of drying these surfaces treated by the liquid takes place, as is widely known, by blowing over it an air stream, especially hot air. A disadvantage of all these known operation procedures is in that the treating operation uses a considerable amount of liquids as well as a large amount of hot air. By a mechanism support of the operating by brush rollers and the like, the amount of liquid may be somewhat reduced, but the disadvantage of this, however, is that the roller brushes are often damaging to parts which protrude from the surface areas.

The purpose of the present invention is to eliminate the disadvantages of these known surface-treating procedures. For this reason, the invention has to do with a process for treating surfaces with liquids, especially for the application of liquids to, or for the removal of same from the surface, and the process in every case is very efficient.

SUMMARY OF THE INVENTION

In general, the present invention consists of accelerating loose particles made from a porous elastic material, such as natural or artificial sponge, on guide tracks and are hurled against the surface areas. In that way stored liquid within the loose particles is transfered to the surface, or the liquid on the surface is absorbed by the particles after contact with the wet surface.

To achieve good operating results in every case, it is important that the particles be thrown from various angles or from various directions toward the treated surface areas. When the procedure is used for liquid application, it is important that the particles be soaked with liquid by spraying etc. and then exposed to the acceleration procedure, wherein special care is to be taken that the particles do not lose moisture during the acceleration process. However, if the procedure of the invention is used for the removal of liquids from surface areas, it is necessary that these particles be dried out, for instance by squeezing or a centrifugal process, before they are exposed to the acceleration process.

To make realistic work possible, it is also important, according to this invention, that the particles be caught and cleaned for re-use after the operation and afterward soaked with liquid or squeezed etc. for removal of the liquid.

Finally, according to this invention, it may be practical that the surface areas be additionally sprayed with liquid, especially when the operation is a cleaning operation.

BRIEF DESCRIPTION OF THE DRAWINGS

The single FIGURE of drawing is a somewhat schematic, vertical sectional view of apparatus embodying the principles of the present invention.

DESCRIPTION OF THE PREFERRED EMBODIMENT

Referring to the drawing, it is assumed that the surface to be cleaned is dirty. Such cleaning procedures occur inside dishwashers or car-washing machines. The procedure may also be used for cleaning the exterior of buildings or for the cleaning of tanks and the like.

According to the drawing, a storage container 1 contains a large number of loose particles 2 formed of a porous material, such as natural or artificial sponge. The particles can be of any shape, for example, they may have the shape of flakes; however, for practical purposes they should be of similar spherical shape. The size of the individual particles 2 depends on the actual use and, when used in dishwashers, is considerably smaller than when large areas are to be cleaned, such as in car washers.

When the liquid is to be applied by means of the porous elastic particles 2 to the surface 3 to be cleaned, these particles are soaked with liquid inside the storage container 1. The liquid may be sprayed from the top by a nozzle 4 into the storage container 1. However, it is also possible to soak every individual particle 2 with liquid before it enters the storage container 1.

The lower part of the storage container 1 is shaped as a hopper 5 and its opening discharges into a metering device which is formed as a driven spoked wheel. Every segment of the spoke wheel can remove at least one particle 2, so that during turning of the wheel, the particles 2 fall in sequence into a transport duct 7 which is connected to a fan 9 through a damper 8. The opposite end is directed against the surface 3 to be cleaned.

By means of the airstream created by the fan 9, the individual particles saturated with liquid are hurled against the surface 3 which is to be cleaned. Since the particles are formed of porous, elastic material, such as natural or artificial sponge, they are squeezed during impact to the surface 3. Therefore, in an area corresponding to the impact area, a pressure increase of the liquid is introduced, within the porous space because of the inertia forces. For that reason the pores are not able to close and the liquid exits through the pores onto the surface to be cleaned. The liquid forms, for a short time, a hydrodynamic slide layer, so that the particle 2 may expand without any restriction by friction.

The dirt particles adhering to the area to be cleaned are loosened or severed by the high liquid pressure and then removed with the liquid as it runs off.

A backward motion of the particles 2 is introduced by their inherit elasticity. While the flow of liquid still is towards the surface 3 to be cleaned and flows through the particles 2, the particle has already lifted itself off the surface. Consequently, the dirt particles may not penetrate into the pores, but are washed away by the liquid from the surface of the particle 2.

It is evident that a relative movement must take place between the transport line 7 for the particles 2 saturated with liquid and the surface 3 to be cleaned and the particles 2 act on every part of the area to be cleaned. Therefore, the transport line 7 does not always have to be directed in a right angle towards the surface 3 to be cleaned. The line may be arranged at variable angles to the surface 3, so that the particles 2 strike the surface 3 to be cleaned from different directions.

Naturally, it is also possible to arrange a large number of transport lines 7 in such a way (side by side and/or one above the other) that a large number of the particles 2 are thrown at the same time onto the surface 3 to be cleaned. The cleaning process hereby can be effectively accelerated.

The particles 2 falling downwardly after the cleaning operation are collected in a suitable receptacle 10 and from there introduced for re-use first into a wahing device and afterward back into the storage container 1.

In certain cases, it is practical to transport loosened up dirt particles faster from the surface 3 to be cleaned by spraying of the surface 3 by an additional liquid. In this case, special nozzles 11 can be directed against the area 3 to be cleaned.

Naturally, there is also the possibility of drying the surfaces 3 by the previously described procedure. In such case, the particles 2 thrown against the area 3 must be dry. Also, in this case, the particles 2 receive first a positive contraction while striking the surface 3. The size of this positive contraction naturally depends on the contact force and the velocity. Thereafter, the particles 2 expand again and absorb the liquid adhering on the surface 3. In this case, the particles 2, which are at least still partially full of water, are collected again and before being returned to the storage container 1, are dried, for example be squeezing or the use of centrifugal force.

The retrieving of the particles after the cleaning or drying operation and the returning to the operation circuit, can be made by suction apparatus as is known in the sand blasting art. In that way, the falling particles may be caught before they fall into the receptacle 10. Naturally, it is also possible to suck the particles from the receptacle 10 itself.

When a pneumatic device, such as a fan 9, is used for the acceleration of the elements, it is recommended that the air from the fan on the suction side be used to transport the falling or the already fallen particles for the return to the storage container 1.

It will be that the described procedure for the treatment of a surface can be used not only for cleaning and drying, but for the application of liquid materials for surface treatment or for corrosion protection. It is also possible, for example, to coat walls, ceilings or floors within buildings or machines and other devices with other liquids.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Process for treating a vertical surface with a liquid which comprises:
   (a) storing porous elastic particles in a hopper adjacent the surface to be treated,
   (b) applying treating liquid to said particles in the hopper,
   (c) metering said particles seriatim from the hopper in a controlled positive manner by a paddle-wheel means to a conduit, which conduit includes a nozzle directed toward said surface, and
   (d) creating an air stream in the conduit toward the nozzle for projecting the particles in the conduit toward said surfaces.

2. Process as recited in claim 1, in which the particles are projected against the surface to be treated at a variety of angles.

3. Process as recited in claim 1, in which the particles are caught, collected, and cleaned for re-use after the operation procedure and returned to the hopper.

4. Process as recited in claim 1, wherein the surface is simultaneously sprayed with a liquid during projecting of the particles toward the surface.

5. Apparatus for treating a vertical surface with a liquid, comprising:
   (a) a plurality of porous elastic particles,
   (b) a hopper arranged in front of the vertical surface for containing a supply of said porous elastic particles,
   (c) means for applying treating liquid to the particles in the hopper,
   (d) a conduit including a nozzle directed toward the vertical surface to be treated, said conduit being positioned below the hopper,
   (e) paddle-wheel metering means located between the hopper and the conduit for positively depositing said particles seriatim at a controlled rate to the conduit, and
   (f) means for creating an air flow in the conduit toward the nozzle for projecting the particles deposited in the conduit by the metering means out of the nozzle so that they impinge on said vertical surface.

6. Apparatus as recited in claim 5, comprising means for spraying the surface to be treated with a liquid.

* * * * *